US012765657B2

(12) United States Patent
Min et al.

(10) Patent No.: US 12,765,657 B2
(45) Date of Patent: Oct. 20, 2026

(54) HAIRDRYER

(71) Applicant: LG ELECTRONICS INC., Seoul (KR)

(72) Inventors: Kyungseok Min, Seoul (KR); Kwangwoon Ahn, Seoul (KR); Hangjin Ban, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 351 days.

(21) Appl. No.: 18/716,862

(22) PCT Filed: Dec. 13, 2021

(86) PCT No.: PCT/KR2021/018850
§ 371 (c)(1),
(2) Date: Jun. 5, 2024

(87) PCT Pub. No.: WO2023/106483
PCT Pub. Date: Jun. 15, 2023

(65) Prior Publication Data

US 2026/0150944 A1 Jun. 4, 2026

(30) Foreign Application Priority Data

Dec. 10, 2021 (KR) ..... 10-2021-0176693

(51) Int. Cl.
*A45D 20/12* (2006.01)

(52) U.S. Cl.
CPC ..... *A45D 20/12* (2013.01); *A45D 2200/202* (2013.01)

(58) Field of Classification Search
CPC ... A45D 20/12; A45D 2200/202; A45D 20/10
See application file for complete search history.

(56) References Cited

U.S. PATENT DOCUMENTS

2017/0112256 A1 4/2017 Bobillier et al.
2018/0049532 A1 2/2018 Hsu
(Continued)

FOREIGN PATENT DOCUMENTS

CN 109527762 A 3/2019
CN 111838934 A 10/2020
(Continued)

*Primary Examiner* — David J Laux
(74) *Attorney, Agent, or Firm* — Birch, Stewart, Kolasch & Birch, LLP

(57) ABSTRACT

Provided is a hairdryer comprising: a cylindrical main body housing including a gas outlet portion in the front surface thereof; a main body assembly inserted into the cylindrical body housing from the rear surface of the main body housing; and a handle housing connected to the lower portion of the main body housing, wherein the main body assembly comprises: a heater module comprising a first heater case formed in a cylindrical shape and a heating wire wound along the outer circumference of the first heater case; and an air guide which surrounds the outer circumference of the heater module and guides the air passing through the heater module to the gas discharge portion, and the air guide has an insulating material which shields the heat generated by the heater module from being transferred to the main body housing.

11 Claims, 10 Drawing Sheets

(56) References Cited

U.S. PATENT DOCUMENTS

| | | | | |
|---|---|---|---|---|
| 2021/0289908 | A1* | 9/2021 | Lo | A45D 20/122 |
| 2025/0151872 | A1* | 5/2025 | Seo | A45D 20/12 |
| 2025/0160497 | A1* | 5/2025 | Seo | A45D 20/122 |

FOREIGN PATENT DOCUMENTS

| | | | |
|---|---|---|---|
| JP | 2021-531150 | A | 11/2021 |
| KR | 20-2016-0003716 | U | 10/2016 |
| KR | 10-2021-0041793 | A | 4/2021 |
| KR | 10-2021-0126347 | A | 10/2021 |

* cited by examiner

HAIRDRYER

CROSS REFERENCE TO RELATED APPLICATIONS

This application is the National Phase of International Application No. PCT/KR2021/018850 filed on Dec. 13, 2021, which claims priority under 35 U.S.C. § 119(a) to Patent Application No. 10-2021-0176693 filed in the Republic of Korea on Dec. 10, 2021, all of which are hereby expressly incorporated by reference into the present application.

TECHNICAL FIELD

The present disclosure relates to a hairdryer.

BACKGROUND ART

When it is intended to remove a desired amount of moisture from hair of a human in a wet state or to style the hair to a desired shape from a current shape, a hairdryer configured to discharge gas through a gas discharge port may be used.

The hairdryer may be provided therein with a fan unit and the like configured to cause gas to flow. The hairdryer including the internal components may be designed for a user to be able to conveniently use the same in consideration of the weight thereof.

When a heater module is positioned at a head part and the temperature of a case increases due to the heat generated by the heater module, there may be a risk of burn injury and internal components such as a controller may be affected. Accordingly, there is need for a structure in which the heat generated by the heater module is fully transmitted to air passing through a passage without being transmitted to the outside or other portions.

In order to use the hairdryer without wires, the hairdryer must include a battery built therein and must assure an additional space in which the battery is mounted. There is need for a hairdryer which is additionally provided with components such as an ion generator and to which accessories are coupled for the purpose of function enhancement.

Because the hairdryer is used in the state of being gripped by a user hand, it is necessary to optimally dispose components in order to prevent the hairdryer from being overly enlarged.

DISCLOSURE

Technical Task

An object of the present disclosure is to provide a hair dryer including an air guide capable of preventing the heat generated by a heater from being directly transmitted to the outside of a housing.

Technical Solutions

The present disclosure provides a hairdryer including a cylindrical body housing including gas discharge portion at a front surface thereof, a body assembly which is inserted into the cylindrical body housing from a rear surface of the body housing, and a handle housing connected to a lower portion of the body housing, wherein the body assembly includes a heater module comprising a cylindrical first heater case and a heating wire wound around an outer circumferential surface of the first heater case, and an air guide surrounding an outer circumferential surface of the heater module and configured to guide air having passed through the heater module to the gas discharge portion, and wherein the air guide includes an insulation material configured to prevent heat generated by the heater module from being transmitted to the body housing.

The air guide may include a cylindrical member having a length equal to or greater than a length of the heater module and a diameter equal to or larger than a diameter of the heater module.

The air guide may be a cylindrical member which gradually decreases in diameter with decreasing distance from the gas discharge portion.

The body assembly may include a board frame which is positioned at a rear side of the heater module and to which a main board is mounted, the board frame comprising a first fastener, and the air guide may include a second fastener which extends from a rear side and is coupled to the first fastener of the board frame.

The second fastener may include a hook configured to be fastened to the first fastener, and two or more extension bridges which extend to the hook from the second side of the air guide.

The body assembly may include a rear cover configured to cover the rear surface of the body housing, and the rear cover may further include a third fastener configured to be fastened to the board frame.

The hairdryer may further include a user input portion mounted to the rear cover.

The air guide may include a curved inner surface connected to the air discharge portion.

The heater module may include a second cylindrical heater case covering an outer circumferential surface of the heating wire, and the second heater case may be in contact with an inner surface of the air guide.

The first heater case may include a cylindrical lateral surface portion, a front surface portion facing the gas discharge portion, and a rear surface portion positioned opposed to the front surface portion, and the hairdryer may include at least one of a front board or an ion generator positioned inside the first heater case.

The heater module may be positioned in front of the connecting portion of the handle housing.

The hairdryer may further include a gas introduction port formed in a lower portion of the handle part, and a blower fan mounted to the handle housing so as to supply air introduced through the gas introduction port to the heater module of the body housing.

Advantageous Effects

The embodiments of the present disclosure are able to prevent the heat generated by the heater from being transmitted to the outside of the body housing and thus to reduce a risk of burn injury of a user in use.

Furthermore, the embodiments of the present disclosure are able to improve the availability of a space by efficiently disposing the heater module in the internal space.

In addition, the embodiments of the present disclosure are able to prevent metal components of the main discharge port from being overheated and thus to lower a risk of burn injury.

Furthermore, the embodiments of the present disclosure are able to prevent damage to components positioned inside the heater module because the heat generated by the heater module is not transmitted inwards in the direction of the first heater case.

BEST MODE FOR DISCLOSURE

Figure 1:
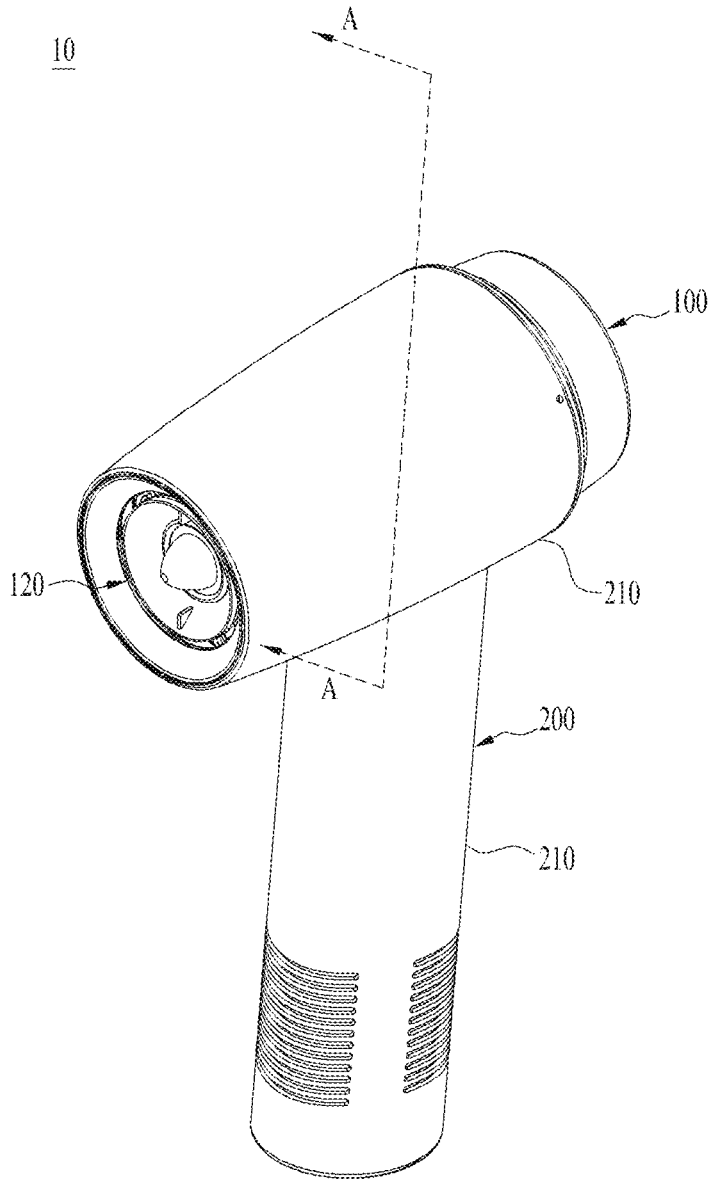
FIG. 1 is a view illustrating the hairdryer according to an embodiment of the present disclosure.

Hereinafter, an embodiment of the present disclosure will be described in detail with reference to the accompanying drawings to be easily implemented by those skilled in the art to which the present disclosure belongs.

However, the present disclosure may be implemented in many different forms and is not limited to embodiments described herein. In addition, in order to clearly describe the present disclosure, components irrelevant to the description are omitted, and like reference numerals are assigned to similar components throughout the specification.

In this specification, duplicate descriptions of the same components are omitted.

Further, in this specification, it will be understood that when a component is referred to as being "connected with" another component, the component may be directly connected with the other component or intervening components may also be present. In contrast, it will be understood that when a component is referred to as being "directly connected with" another component in this specification, there are no intervening components present.

Further, in this specification, the terminology used herein is for the purpose of describing a specific embodiment only and is not intended to be limiting of the present disclosure.

Further, in this specification, the singular forms "a" and "an" are intended to include the plural forms as well, unless the context clearly indicates otherwise.

Further, in this specification, it will be further understood that the terms "comprises", "comprising", "includes", and "including" specify the presence of the certain features, numbers, steps, operations, elements, and parts or combinations thereof, but do not preclude the presence or addition of one or more other features, numbers, steps, operations, elements, and parts or combinations thereof.

Further, in this specification, the term 'and/or' includes a combination of a plurality of listed items or one of the plurality of listed items. In this specification, 'A or B' may include 'A', 'B', or 'both A and B'.

Figure 2:
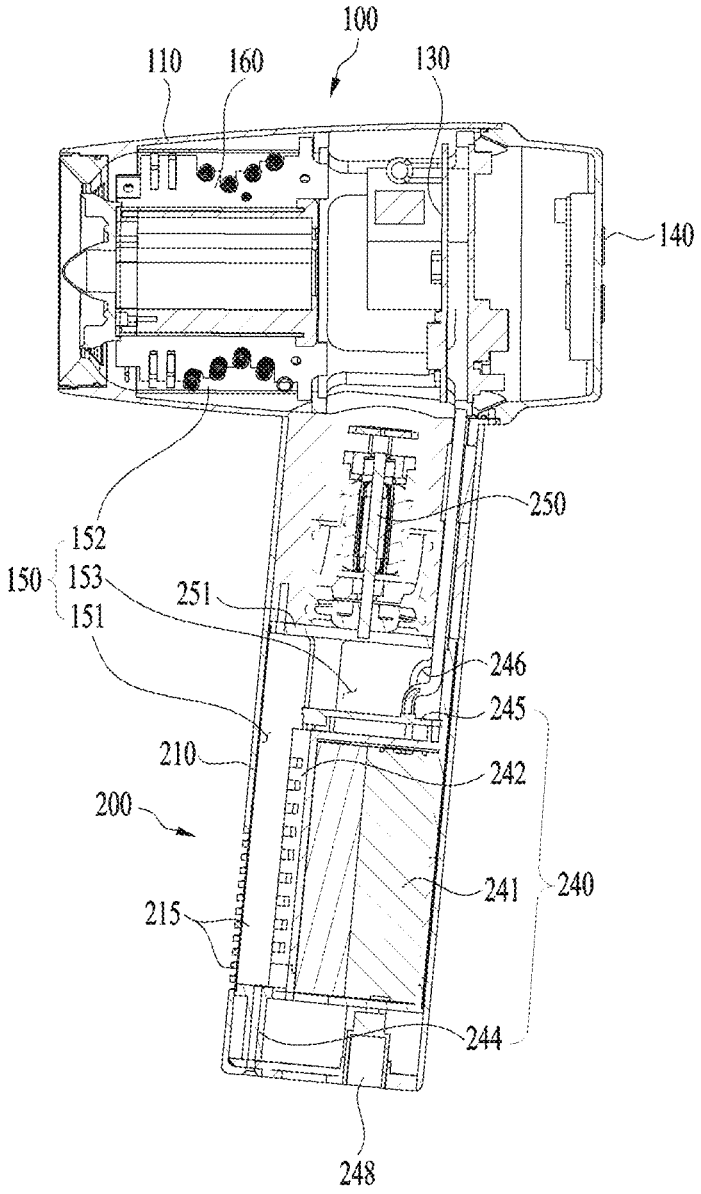
FIGS. 2 and 3 are cross-sectional views illustrating the interior of the hairdryer according to an embodiment of the present disclosure.

FIG. 1 illustrates a hairdryer 10 according to an embodiment of the present disclosure. FIG. 2 illustrates the cross-section of the interior of the hairdryer 10 shown in FIG. 1.

As illustrated in FIG. 1, the hairdryer 10 according to an embodiment of the present disclosure includes a body part 100 and a handle part 200. The body part 100 includes an gas discharge portion 120 through which air introduced from the outside is discharged.

As illustrated in FIG. 2, the body part 100 may have formed therein an air passage 150 through which gas flows. The gas passage 150 may extend to the inside of the body part 100 from the handle part 200.

The gas passage 150 may be formed by the inside of the body part 100 and the inside of the handle part 200, and may be defined as a region which extends to the gas discharge portion 120 from the air introduction portion 215. The body part 100 may include the gas discharge portion 120 through which the air flowing in the gas passage 150 is discharged to the outside. The body part 100 may have a shape which extends parallel to a direction in which air is discharged from the gas discharge portion 120, and may have various cross-sectional shapes such as circular shape and a polygonal shape.

The air flowing in the body part 100 is introduced through the air introduction portion 215. The air introduction portion 215 may be provided at the body part 100 or the handle part 200. When the handle part 200 includes the air introduction portion 215, as illustrated in FIGS. 1 and 2, the air passage 150 may extend to the body part 100 from the handle part 200. Specifically, the air passage 150 may extend to the gas discharge portion 120 from the air introduction portion 215.

Gas may be introduced from the outside through the air introduction portion 215 provided at the body part 100 or the handle part 200. The air introduced through the air introduction portion 215 may flow through the gas passage 150 and may then be discharged to the outside through the gas discharge portion 120 provided at the body part 100.

The handle part 200 may extend from the body part 100. Referring to FIGS. 1 and 2, there is shown the handle part 200 which extends approximately downwards from the body part 100.

The handle part 200 may have a shape which extends from the body part 100. The handle part 200 may be molded integrally with or separately from the body part 100, and may be coupled to the body part 100.

When the handle part 200 is manufactured separately from the body part 100 and is coupled to the body part 100, the length or the direction of the handle part 200 with respect to the body part 100 may be constant or variable.

For example, the handle part 200 may be coupled to the body part 100 via a hinge coupler such that the direction in which the handle part 200 extends is variable. In other words, the handle part 200 may be constructed so as to be bent with respect to the body part 100.

The handle part 200 may be a portion which is gripped by a user. Accordingly, the handle part 200 may have such a shape as to improve grip convenience. Although the direction in which the handle part 200 extends may be variously changed, the direction in which the handle part 200 extends from the body part 100 may be referred to as a downward direction for convenience of explanation.

In other words, the up-and-down direction in the present disclosure may be defined based on the handle part 200. For example, the handle part 200 may have a shape which extends downwards from the body part 100, and the body part 100 may be positioned above the handle part 200.

Accordingly, the up-and-down direction in the present disclosure should not necessarily be understood as a direction perpendicular to the ground, and may include an inclined direction as shown in FIG. 2. For convenience of explanation, the up-and-down direction may be defined based on the longitudinal direction of the handle part 200.

Referring to FIG. 2, the hairdryer 10 according to an embodiment of the present disclosure may include a fan unit 250 configured to cause gas to flow and to control velocity of gas discharged through the gas discharge portion 120. The fan unit 250 may be disposed in the gas passage 150 so as to cause gas to flow, and may be disposed in the inside of the body part 100 or the inside of the handle part 200.

For example, when the gas introduction portion 215 is disposed at the handle part 200, the gas passage 150 may extend to the gas discharge portion 120 of the body part 100 from the gas introduction portion 215 of the handle part 200, and the fan unit 250 may be disposed in the gas passage 150 positioned at the handle part 200.

The hairdryer 10 may include a battery module 240 in order to be wirelessly usable. When the battery module 240 is disposed at the body part 100, the weight of the body part 100 may be increased, and convenience of use is thus deteriorated. Accordingly, the battery module 240 may be disposed at the handle part 200, as illustrated in FIG. 2. Because the weight of the battery module 240 is greater than the fan unit 250 disposed at the handle part 200, the battery module 240 may be positioned at the lower portion of the handle part 200, and the fan unit 250 may be positioned at the upper portion of the handle part 200.

Furthermore, the body part 100 may be provided therein with a heater module 160 capable of controlling the temperature of discharged gas. The heater module 160 may be constructed so as to have various forms, and may be provided at various positions. FIG. 2 schematically illustrates the heater module 160 provided in the body part 100.

The heater module 160 may be of various kinds. The heater module 150 may be operated such a manner as to supply current to a coil-shaped resistor to generate heat and thus to heat gas.

Here, the heater module may not necessarily have a coil-shaped resistor, and may be any one of various kinds of heater modules which include, for example, a thermoelectric element capable of controlling temperature of gas.

The operation of the hairdryer 10 according to an embodiment of the present disclosure will now be schematically described in conjunction with flow of gas.

First, a user may manipulate a power button disposed at the body part 100 or the handle part 200. When the power button is turned on, the fan unit 250 is activated such that gas is introduced into the hairdryer 10 through the gas introduction portion 215.

The gas introduced through the gas introduction portion 215 flows toward the gas discharge portion 120 along the gas passage 150 by means of the fan unit 250, and is then discharged to the user through the gas discharge portion 120.

During this procedure, the gas in the gas passage 150 may be controlled in flow rate by means of the fan unit 250, and may be controlled in temperature by means of the heater module 160.

The hairdryer 10 according to an embodiment of the present disclosure may include controller 130. The controller 130 may be connected to the fan unit 250, the heater module 160, the power button, an operation board and the like so as to control the components.

The operation of the fan unit 250 and the heater module 160 may be conducted by user manipulation of the operation board, or may be automatically conducted according to an operation mode which is previously set in the controller 130.

The gas introduction portion 215 may have a plurality of gas introduction holes formed through a handle case 210.

The gas passage 150 may extend to the gas discharge portion 120 from the gas introduction portion 215 to allow gas to flow therethrough. The gas passage 150 may include a second passage 154 and 155, which is positioned at the body part 100, a first passage 151, 152 and 153, which is positioned at the handle part 200 and extends in the longitudinal direction of the handle part 200.

The gas introduction portion 215 may be positioned at the lower portion of the handle part 200, and the gas discharge portion 120 may be positioned at the end of the body part 100 opposed to the portion of the body part 100 to which the handle part 200 is coupled.

The gas passage 150 may be constructed such that the first passage 151, 152 and 153 and the second passage 154 and 155 are disposed in an L-shaped arrangement, and may include a pressure compensation passage 153 and 154 in order to prevent flow rate from being reduced at the bent portion of the gas passage 150. The pressure compensation passage 153 and 154 is characterized by having a sufficient space or a gentle slope and by being changed in flow direction.

Because a large space is required to form a gently sloped passage, the pressure compensation passage 153 and 154 according to the present disclosure is characterized by having a large space.

The fan unit 250 may be provided in the handle part 200 so as to cause the gas, introduced into the handle part 200, to flow toward the gas discharge portion 120. The fan unit 250 may be disposed in the gas passage 150 so as to cause the gas to flow.

A conventional hairdryer 10 includes the fan unit 250 having a relatively large fan because the fan unit 250 is positioned at the body part 100. In contrast, because the fan unit 250 according to the embodiment of the present disclosure is positioned at the handle part 200 and the diameter of the handle part 200 is smaller than the diameter of the body part 100, the size of the fan unit 250 is accordingly reduced.

Because the size of the fan of the fan unit 250 is reduced, it is possible to cause air to flow through the gas passage 150 by rotating the motor at a high RPM.

Particularly, the voltage is lower in the case in which the battery module 240 is used than the case in which a wired power source is connected. A DC power source of 10 V is used in the wireless case whereas An AC power source of 215 V is used in the wired case. When the fan unit 250 is operated using a low voltage power of the battery module 240, it is possible to drive the fan unit 250 by raising the voltage using a boosting module in order to obtain wind of sufficient intensity.

Because the battery module 240 generates heat, it is possible to cool the battery module 240 by disposing the battery module 240 at the gas passage 150. Because the battery module 240 is positioned at the handle part 200, the battery module 240 may be positioned at the first passage disposed in the handle part.

More specifically, the first passage 151, 152 and 153 may include a lower passage 151 which is connected to the gas introduction portion 215 and at which the battery module 240 is positioned, and an upper passage 152 at which the fan unit 250 is positioned and which is formed through the fan unit 250.

Unless otherwise specially indicated in the following disclosure, the direction in which gas is discharge is defined as a forward direction, and the opposite direction is defined as a rearward direction. The following description will be given based on the case in which the gas discharge portion 120 is provided at the front side of the body part 100 and the longitudinal direction of the body 100 is parallel to the forward/backward direction.

Figure 3:
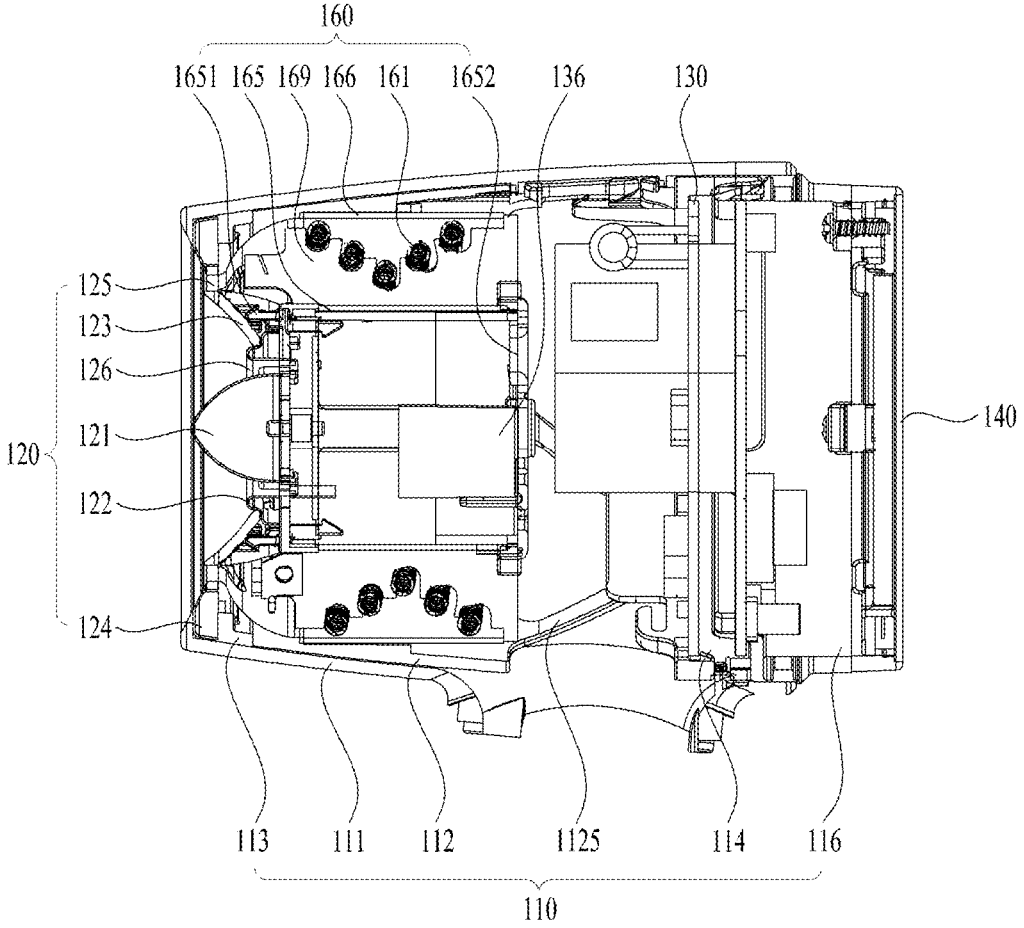
Figure 4:
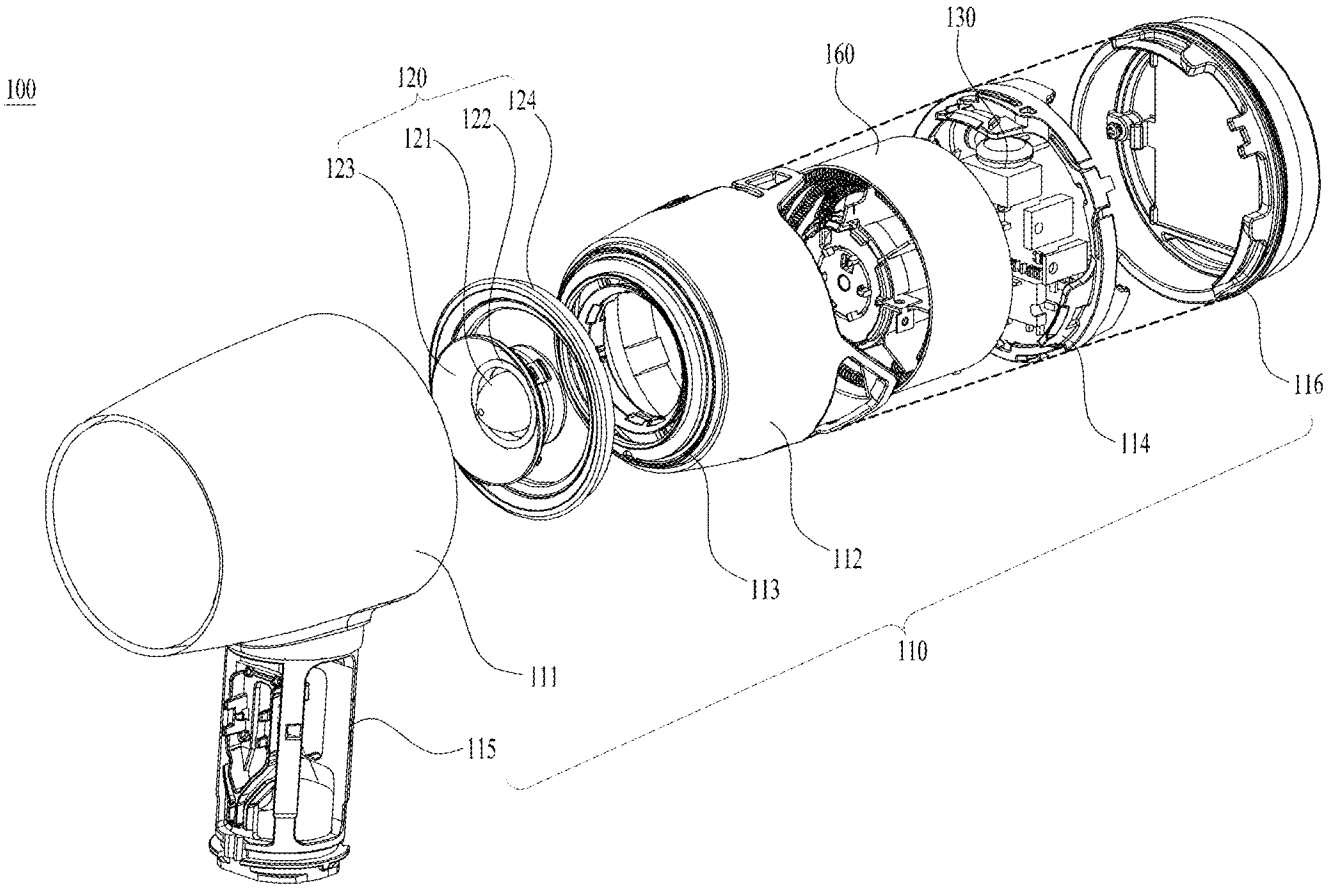
FIG. 4 is an exploded perspective view of the hairdryer according to an embodiment of the present disclosure.
Figure 5:
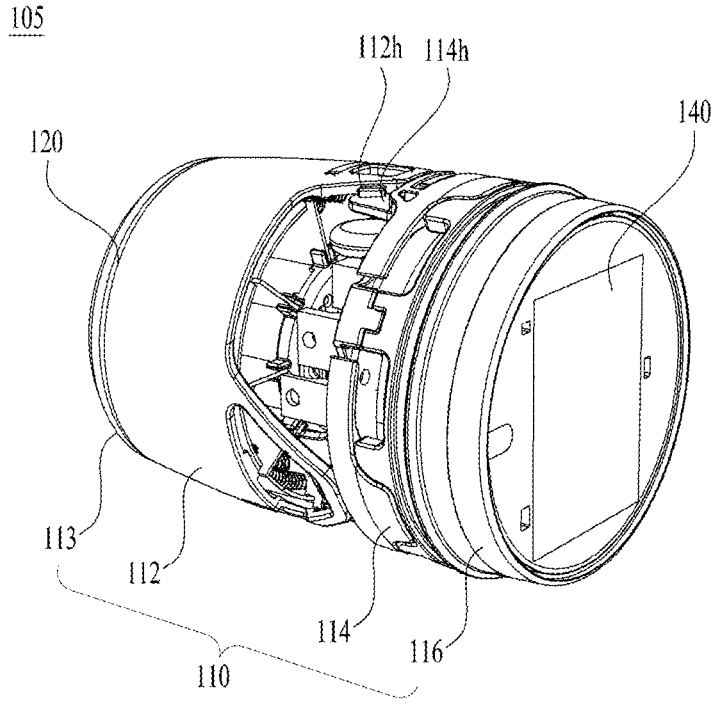
FIG. 5 is a view illustrating a body assembly mounted in a handle part according to the present disclosure.

FIG. 3 is a cross-sectional view of the body part 100 of the hairdryer 10 according to an embodiment of the present disclosure. FIG. 4 is an exploded perspective view of the hairdryer 10 according to an embodiment of the present disclosure. FIG. 5 is a view illustrating a body assembly 105 mounted in the handle part according to the present disclosure.

The body part 100 may include the heater module 160, the controller 130 configured to control the hairdryer 10, and the user input portion 140. The body part 100 may include a cylindrical body housing 110. The body part 100 may be provided at the front surface thereof with a main discharge port 125 and at the rear surface thereof with the user input portion 140.

As illustrated in FIG. 5, the heater module 160, the controller 130, and the user input portion 140 may be assembled with one another so as to constitute the body assembly 105. The body assembly 105 may be inserted into the body housing 100 in the direction of the front surface from the rear surface of the body housing 110, thereby constituting the body part 100.

Because the body assembly 105 is inserted in the direction of the front surface from the rear surface of the body housing 110, the diameter of the front surface of the body housing 100 may be equal to the diameter of the rear surface of the body housing 110, or may be slightly smaller than the diameter of the rear surface of the body housing 110, as illustrated in FIG. 3.

In order to connect the handle part 200 to the lower portion of the cylindrical body housing 110, a connecting frame 115 which overlaps the handle case may extend downwards from the body part 100. The portion of the body housing 110 at which the connecting frame is formed may be open so as to allow the passage in the handle part 200 to communicate with the passage in the body part 100.

Based on the point at which the connecting frame is positioned, the heater module 160 may be positioned at the front side whereas the controller 130 and the user input portion 140 are may be positioned at the rear side. The vertical airflow in the handle part 200 may be changed into a forward airflow in the space between the heater module 160 and the controller 130.

The heater module 160 may include a heating wire 161 wound around a cylindrical housing. The housing may include a first heater case 165 positioned inside the heating wire 161 and a second heater case 166 positioned outside the heating wire 161. Specifically, the doughnut-shaped space defined between the first heater case 165 and the second heater case 166 may serve as a heating passage 155, and the heating wire 161 may be disposed in the space between the first heater case 165 and the second heater case 166.

The heating wire 161 may be wound around the first heater case 165 in a circular shape, and may be wound plural turns so as to form a coil shape. The diameter of the heating wire 161 wound around the housing may vary as illustrated in FIG. 3. The air flowing through the heating passage 155 defined between the first heater case 165 and the second heater case 166 may come into sufficient contact with the heating wire 161.

The hairdryer may further include plates for heating wire 161 which radially extend toward the second heater case 166 from the first heater case 165. Each of the plates for the heating wire 161 may have grooves in which the heating wire 161 is seated. The grooves may be positioned at different distances from the center of the heater housing.

As the resistance of the heating wire 161 increases, the temperature may be increased. Particularly, because the heating wire 161 may be burn out when the resistance of the heating wire 161 is low in the case in which AC power source of high voltage is applied, the heating wire 161 may be composed of a coil-shaped heating wire having a small diameter.

Specifically, a coil-shaped heating wire 161 which defines a tube having a diameter ranging from 2 to 5 mm may be wound around the first heater case 165 so as to realize the heating wire 161. As heat is generated by the heating wire 161, the temperature of the air flowing through the heating passage 155 may be increased, thereby providing high temperature air.

The heating wire 161 having this structure may be disposed adjacent to the outer circumferential surface of the body housing 110, and the heat generated by the heating wire 161 may be transmitted to the body housing 110, thereby raising the temperature of the body housing 110. Because the body housing 110, which defines the appearance of the hairdryer 10, may come into direct contact with a user, there is a risk of burn injury when the temperature of the body housing 110 increases to a high temperature.

Accordingly, there is a need to provide a heat insulation structure configured to block the heat generated by the heating wire 161 to prevent the heat from being transmitted to the body housing 110. In order to obtain heat insulation capacity while minimizing volume, a heat insulation structure may be realized using mica or the like. A heat insulation material may be used as the material of the second heater case 166. However, because the second heater case 1 defines the heating passage 155, there is a problem in that the efficiency of temperature rise of the air flowing through the heating passage 155 is lowered when the temperature of the second heater case 166 is low. In order to solve the problem, an air guide 112 configured to guide air to the gas discharge portion 120 from the heater may be provided so as to surround the heater.

The air guide 112 may include an insulation material or a heat insulation material such as mica, and may prevent the heat generated by the heating wire 161 from being transmitted to the body housing 110.

The air guide 112 may include a curved surface connected between the front end of the heater and the gas discharge portion 120, and may extend rearwards to surround the heater for heat insulation. The air guide 112 may have a length greater than the longitudinal length of the heater module 160 so as to cover the heater module 160, and may be composed of a cylindrical member having a diameter equal to or larger than the diameter of the heater module 160.

As illustrated in FIG. 4, the gas discharge portion 120 may be disposed at the front surface of the air guide 112, and the heater module 160 may be inserted into the enlarged portion of the air guide 112. In the case in which the diameter of the body housing 110 decreases toward the gas discharge portion 120, the air guide 112 may have a cylindrical form the diameter of which also decreases in the direction of the front surface thereof adjacent to the gas discharge portion 120.

As illustrated in FIG. 5, the air guide 112 may be fastened to a board frame 114 to which the main board of the controller 130 is mounted, and may be coupled to a rear cover 116 to which the user input portion 140 of the board frame 114 is seated and which defines the rear surface of the body housing 110.

As illustrated in FIG. 5, the air guide 112, the board frame 114, and the rear cover 116 may be coupled to one another so as to constitute the body assembly 105. Furthermore, the heater module 160 mounted to the air guide 112, the main board coupled to the board frame 114, and the user input portion 140 mounted to the rear cover 116 may also constitute the body assembly 105.

Figure 6:
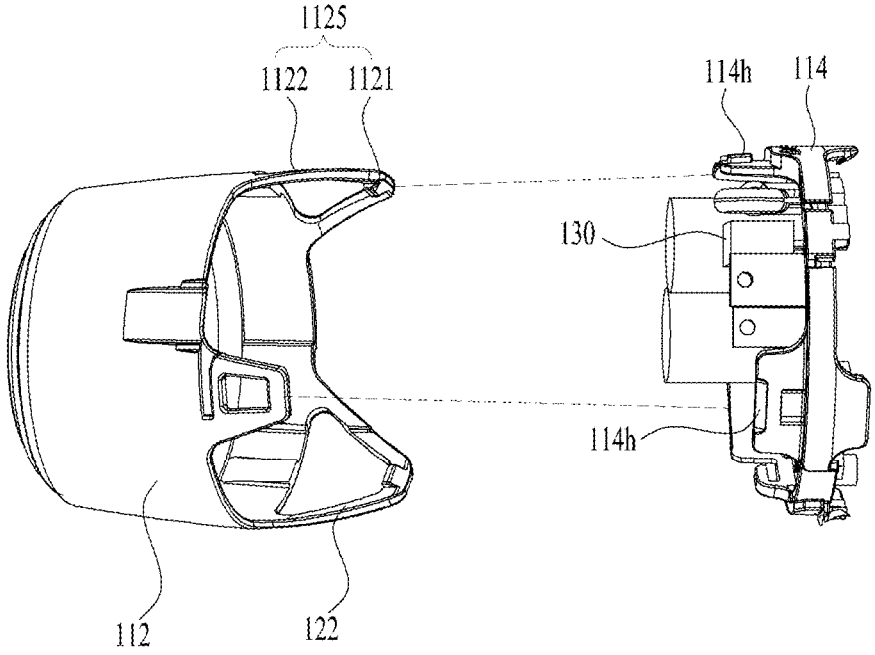
FIG. 6 is a view illustrating an air guide and a board frame of the hairdryer according to an embodiment of the present disclosure.

FIG. 6 is a view illustrating the air guide 112 and the board frame 114 of the hairdryer 10 according to an embodiment of the present disclosure. The board frame 114 to which the main board 130 is mounted may be composed of a ring-shaped member, as illustrated in FIG. 6.

The air guide 112 may include a second fastener 1125 which is to be coupled to the first fastener 114*h* of the board frame 114. The first fastener and the second fastener may be embodied as a hook and a hook groove, and may each include a plurality of ones arranged therearound, as illustrated in FIG. 6.

The connecting frame 115 may be positioned between the heater module 160 and the main board 130. The heater module 160 should be spaced apart from the main board 130 such that the air introduced from the handle part 200 flows toward the heater. Accordingly, the second fastener of the air guide 112 may have an elongated shape, as illustrated in FIG. 6.

The second fastener 1125 may include a hook 1121 which is coupled to the first fastener 114*h* and an extension bridge 1122 which extends from the air guide 112. Because there may be a problem in rigidity of the second fastener 1125 when the extension bridge 1122 extends long, the extension bridge 1122 may include two or more extension bridges 1122 to stably fix the hook 1121 to the first fastener 114*h*.

In the embodiment shown in FIG. 6, the extension bridge 1122 may extend from the hook 1121 to define a predetermined angle such that the second fastener 1125 has a triangular shape.

The rear cover 116 may include a third fastener to be fastened to the board fastener. The rear cover 116 may be exposed to the outside of the hairdryer 10. The rear surface of the rear cover 116 may be provided with a touch input portion so as to control the hairdryer 10, and may also include a display configured to display icons configured to guide control of the hairdryer 10 or corresponding to the user input portion 140.

The gas discharge portion 120 may include a main discharge port 125 having a size smaller than the size of the heating passage 155 in order to discharge the air passing through the heating passage 155 at high velocity. In order to form the main discharge port 125 smaller than the heating passage 155, the gas discharge portion 120 may include a discharge cover 121, 122 and 124. The discharge cover 121, 122 and 124 may have a curved surface to efficiently diffuse the air.

The ring-shaped main discharge port 125 connected to the heating passage 155 may have a ring shape smaller than the heating passage 155. The main discharge port 125 may have a cone-shaped inner surface to guide diffusion of the air discharged from the main discharge port 125, and may include a first ring cover 124 positioned around the outer periphery thereof.

Figure 10:
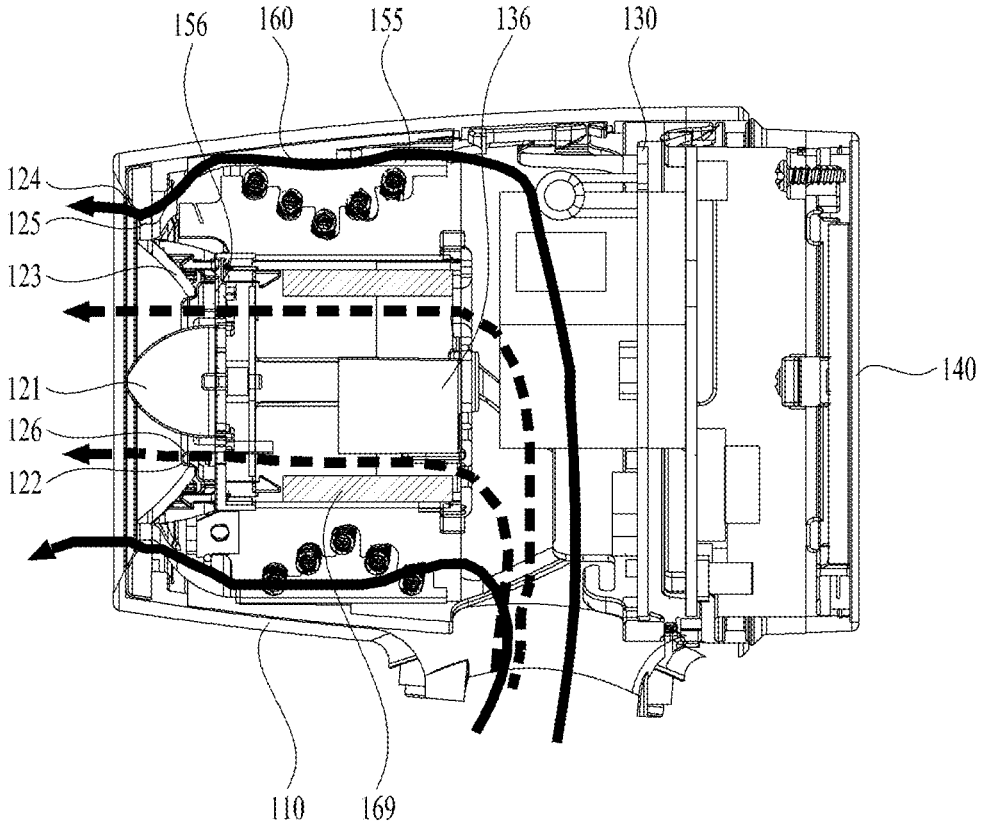
FIG. 10 is a cross-sectional view illustrating a main passage and a subsidiary passage of the hairdryer according to an embodiment of the present disclosure.

In order to form the flow passage which is narrowed to the main discharge port 125 from the heating passage 155, the air guide 112 may have a curved surface connected between the heater module 160 and the main discharge port 125, as illustrated in FIG. 10. The first ring cover 124 may cover the front surface of the air guide 112 to define the appearance of the hairdryer 10. The discharge cover 121, 122 and 124 may be coupled to the front surface of the air guide 112 to constitute one component of the body assembly 105.

The assembly shown in FIG. 5 in which the air guide 112, the board frame and the rear cover 116 are coupled to one another may be inserted the body housing 110 so as to constitute the body part 100, as illustrated in FIG. 3.

Figure 7:
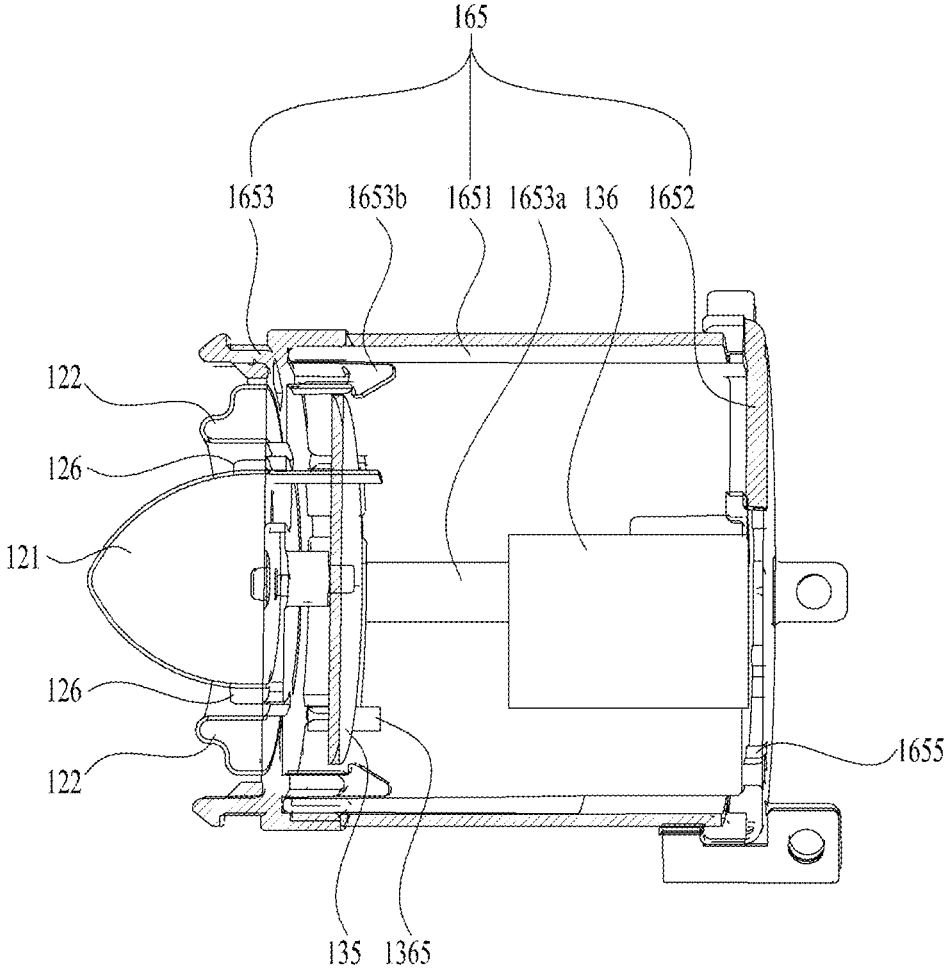
FIG. 7 is a cross-sectional view of a first heater case of the hairdryer according to an embodiment of the present disclosure.
Figure 8:
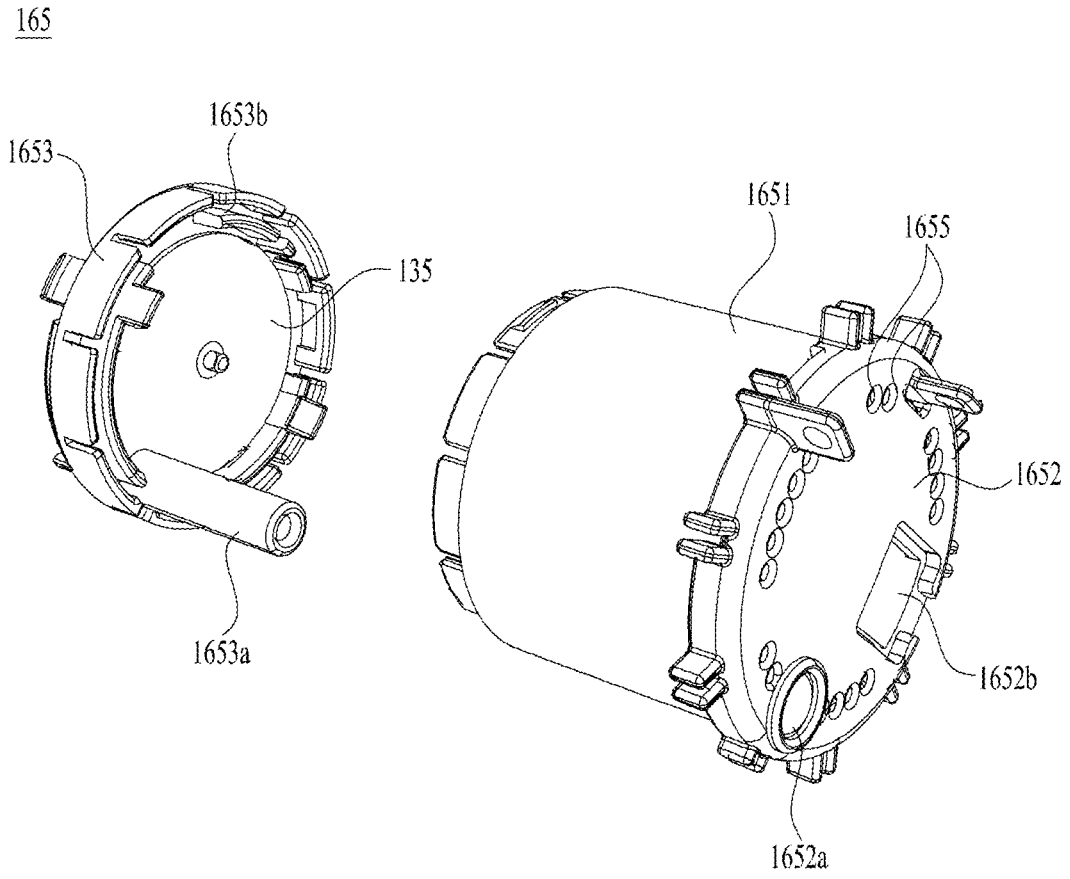
FIGS. 8 and 9 are exploded perspective views of the first heater case according to an embodiment of the present disclosure.
Figure 9:
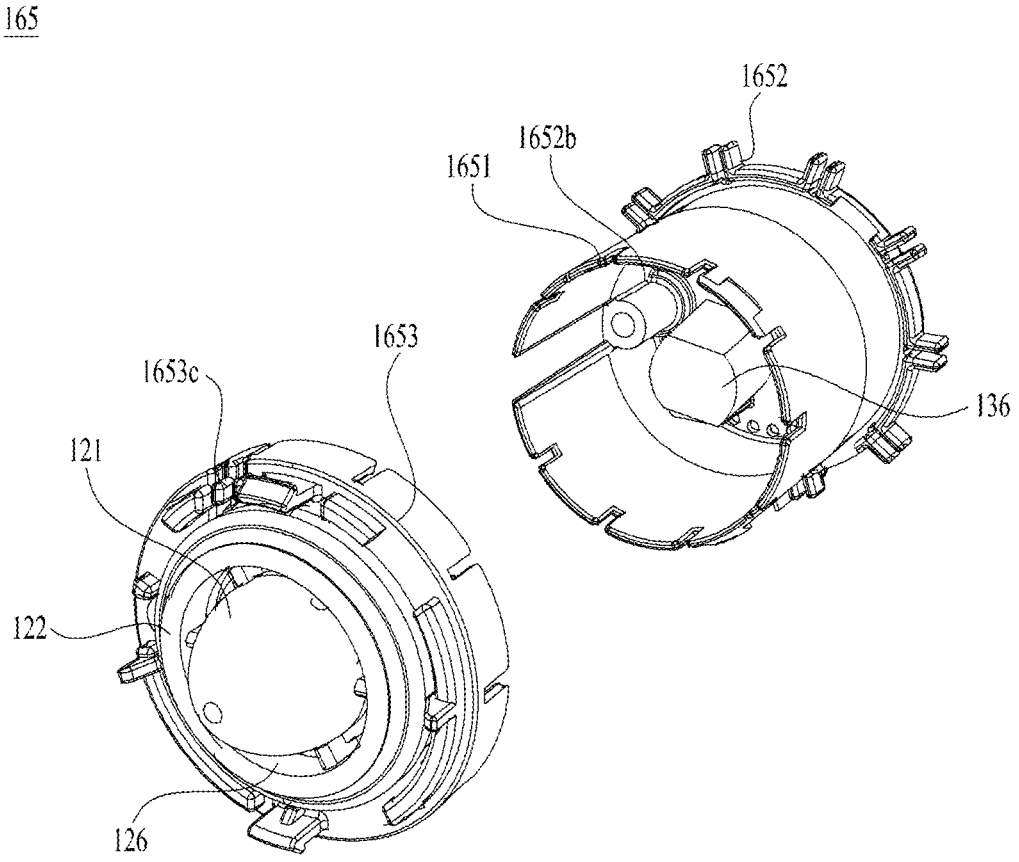

FIG. 7 is a cross-sectional view of the first heater case 165 of the hairdryer 10 according to an embodiment of the present disclosure. FIGS. 8 and 9 are exploded perspective views of the first heater case 165 according to an embodiment of the present disclosure.

Because the first heater case 165, which is a cylindrical member, is provided with the heating wire 161 positioned on the outer circumferential surface thereof but is not provided in the internal space thereof with the heating wire 161, other components may be disposed in the internal space of the first heater case 165.

In order to utilize the inside of the first heater case 165, the first heater case 165 having a cylindrical shape may be composed of at least two pieces so as to open the inside, as illustrated in FIGS. 8 and 9.

The first heater case 165 may include a cylindrical lateral surface portion 1651, a front surface portion 1653 positioned at the front surface of the lateral surface portion 1651, and a rear surface portion 1652 positioned at the rear surface of the lateral surface portion 1651. The front surface portion 1653 and the rear surface portion 1652 may cover the two ends of the cylindrical lateral surface portion 1651 to define the internal space.

The present disclosure discloses an embodiment in which the front surface portion 1653 is separated from the lateral surface portion 1651 and the rear surface portion 1652 is formed with the lateral surface portion 1651 and in which the front surface portion 1653 and the rear surface portion 1652 may be fastened by means of a fastener such as a screw. In order to fasten the front surface portion 1653 and the rear surface portion 1652, the front surface portion 1653 may include a fastener 1653*a* which projects toward the rear surface portion 1652, as illustrated in FIG. 8.

A screw may be inserted forwards into a screw hole 1652*a* in the rear surface of the rear surface portion 1652 and may then be fastened to the projecting fastener 1653*a* of the front surface portion 1653. The lateral surface portion 1651 may have formed therein a groove at a location corresponding to the projecting fastener 1653*a* so as to maintain the position of the projecting fastener 1653*a* and to fix the front surface portion 1653 without rotation relative to the lateral surface portion 1651.

The hairdryer 10 may include a front board 135 as a representative example. The front board 135 may be connected to the components positioned on the front surface of the hairdryer 10 and may be connected to the main board. The rear surface portion 1652 may be provided therethrough with a cable hole 1652*b* so as to allow a cable connected to the main board to pass therethrough. The front surface portion 1653 may further include a hook 1653*b* configured to hold the front board 135.

When any of a temperature sensor 1653*c* positioned on the front surface of the hairdryer 10 and accessories coupled to the front surface of the body housing 100 require supply of power, power may be supplied to the component so as to connect the component to the main board for control.

As one example of the accessories, a rotating brush or an LED diffuser equipped with an LED module for scalp care may be coupled to the body housing, thereby enabling upgrade of the hairdryer to a multipurpose hairdryer 10 capable of performing hair care while drying hair.

Here, in order to electrically connect the hairdryer 10 to the accessories coupled to the front surface of the body housing 110, that is, to the gas discharge portion 120, the discharge cover 121, 122 and 124 of the gas discharge portion 120 of the hair dryer 10 may be used as an electrode. The discharge cover 121, 122 and 124 may be made of a conductive metal material and may be connected to the front board 135 such that the cone cover 121 and the first ring cover 124 of the discharge cover 121, 122 and 124 may be used as electrodes.

Alternatively, in order to form a subsidiary passage 156 to be described later, the second ring cover 122 adjacent to the periphery of the cone cover 121 may further be provided, and the cone cover 121 and the second ring cover 122 may be used as electrodes. Because the cone cover 121 and the second ring cover 122 are coupled to the front surface of the first heater case 165, the cone cover 121 and the second ring cover 122 are easily connected to the front board 135 mounted in the first heater case 165.

When an accessary such as an LED diffuser is coupled to the front surface of the body housing 110, the accessary may be connected to the controller 130 via the discharge cover 121, 122 and 124 such that the accessary coupled to the front surface of the housing is controlled and driven by the controller 130 of the hairdryer 10. The temperature sensor 1653*c* may be positioned at the gas discharge portion 120 and may be connected to the front board 135 in order to measure temperature of the air discharged from the heater module 160. A temperature measurement portion may be positioned on the outer surface in order to measure temperature of the upper passage, and an electrode configured to connect the temperature sensor to the front board 135 may be connected to the outside through the first heater case 165.

A signal wire connected to the front board 135 may extend through an opening formed through the front surface portion 1653 of the first heater case 165, and the outer surface of the front surface portion 1653 may have formed therein a groove in which the signal wire is positioned.

An ion generator 136 may further be provided in the first heater case 165. The ion generator 136 is a device configured to create negative ions which have effects of sterilization, cellular activation and odor removal. Furthermore, the negative ions have effects of prevention of static electricity and of improving hair texture by smoothly arranging cuticles of the hair.

Because the negative ions created by the ion generator 136 are supplied through a negative ion brush or a negative ion pin 1365, it is possible to supply the negative ions created by the ion generator 136 in the direction of the heating passage 155 through the outer surface of the first heater case 165.

However, there may be a problem in that the temperature of the first heater case 165 increases due to the heating wire 161 positioned at the periphery of the first heater case 165 and thus the temperature of the internal space of the first heater case 165 also increases. When the temperature of the internal space of the first heater case 165 increases, there is the concern that electronic components such as the front board 135 and the ion generator 136 which are positioned inside the first heater case 165 are damaged due to high heat.

In order to lower the internal temperature of the first heater case 165, the subsidiary passage 156 formed through the inside of the first heater case 165 may further be provided. FIG. 10 is a cross-sectional view illustrating the heating passage 155 and the subsidiary passage 156 of the hairdryer 10 according to an embodiment of the present disclosure.

Because it is possible to efficiently raise the temperature of discharged air when the air sufficiently passes over the heating wire 161, the rear surface portion 1652 of the first heater case 165 may be closed in order to guide the air between the first heater case 165 and the second heater case 166.

In order to realize the subsidiary passage 156 formed through the first heater case 165 as described above, a plurality of vent holes 1655 may be formed along the periphery of the rear surface portion 1652. Some of the air supplied from the first passage may be introduced into the inside of the first heater case 165 through the vent holes 1655. Here, the temperature of the air supplied from the first passage is not high, it is possible to obtain an effect of lowering the temperature of the first heater case 165.

In order to lower the temperature of the first heater case 165, the plurality of vent holes 1655 may be formed along the periphery of the rear surface portion 1652 so as to allow the air to flow along the inner surface of the first heater case 165. When the size of the vent holes 1655 is overly large, the amount of air supplied to the heating passage 155, which is the main passage, is reduced. Accordingly, the size of the subsidiary passage 156 may be smaller than the size of heating passage 155.

The air having passed through the vent holes 1655 may flow along the inner surface of the first heater case 165, and may then be discharged through the opening formed through the periphery of the front surface portion 126. In order to form a subsidiary discharge port 126 connected to the subsidiary passage 156, the discharge cover 121, 122 and 124 may further include the second ring cover 122 positioned around the cone cover 121. The subsidiary discharge port 126 may be positioned between the second ring cover 122 and the cone cover 121 so as to allow the air having passed through the subsidiary passage 156 to be discharged.

When the subsidiary passage 156 is provided, the brush or pin 1365 of the ion generator 136 may be positioned in the first heater case 165 without having to extend to the outside of the first heater case 165.

Like the air guide 112 as an insulation member disposed outside the second heater case 166, a heat insulation tube 169 including an insulation material may further be provided in the first heater case 165. Consequently, transmission of heat to the inside of the first heater case 165 is prevented, thereby making it possible to prevent rise of the internal temperature of the first heater case 165 while increasing an amount of heat supplied to the air passing through the heating passage 155.

The air passing through the subsidiary passage 156 has effects not only of protecting the internal components of the first heater case 165 but also of lowering the temperature of the discharge cover 121, 122 and 124 because the air passes through the discharge cover 121, 122 and 124. Because the discharge cover 121, 122 and 124 is also exposed to the outside, there is a risk of burn injury. Accordingly, it is possible to lower the temperature of the discharge cover 121, 122 and 124 using low temperature air in the subsidiary passage 156.

The embodiments of the present disclosure are able to prevent the heat generated by the heater from being transmitted to the outside of the body housing 110 and thus to reduce a risk of burn injury of a user in use.

Furthermore, the embodiments of the present disclosure are able to improve the availability of a space by efficiently disposing the heater module 160 in the internal space.

In addition, the embodiments of the present disclosure are able to prevent metal components of the main discharge port 125 from overheating, thus lowering the risk of burn injury.

Furthermore, the embodiments of the present disclosure are able to prevent damage to components positioned inside the heater module 160 because the heat generated by the heater module 160 is not transmitted inwards in the direction of the first heater case 165.

Although a specific embodiment of the present disclosure has been illustrated and described above, those of ordinary skill in the art to which the present disclosure pertains will appreciate that various modifications are possible within the limits without departing from the technical spirit of the present disclosure provided by the following claims.

What is claimed is:

1. A hairdryer comprising:

a cylindrical body housing including gas discharge portion at a front surface thereof;

a body assembly which is inserted into the cylindrical body housing from a rear surface of the body housing; and a handle housing connected to a lower portion of the body housing, wherein the body assembly comprises:

a heater module comprising a cylindrical first heater case and a heating wire wound around an outer circumferential surface of the first heater case; and an air guide surrounding an outer circumferential surface of the heater module and configured to guide air having passed through the heater module to the gas discharge portion, and wherein the air guide comprises an insulation material configured to prevent heat generated by the heater module from being transmitted to the body housing, wherein the body assembly comprises a board frame which is positioned at a rear side of the heater module and to which a main board is mounted, the board frame comprising a first fastener, wherein the air guide comprises a second fastener which extends from a rear side and is coupled to the first fastener of the board frame, and wherein a rear cover comprises a third fastener configured to be fastened to the board frame.

2. The hairdryer of claim 1, wherein the air guide comprising a cylindrical member having a length equal to or greater than a length of the heater module and a diameter equal to or larger than a diameter of the heater module.

3. The hairdryer of claim 2, wherein the air guide is a cylindrical member which gradually decreases in diameter toward the gas discharge portion.

4. The hairdryer of claim 1, wherein the second fastener comprises: a hook configured to be fastened to the first fastener; and two or more extension bridges which extend to the hook from a second side of the air guide.

5. The hairdryer of claim 1, wherein the body assembly comprises a rear cover configured to cover the rear surface of the body housing, and wherein the rear cover comprises a third fastener configured to be fastened to the board frame.

6. The hairdryer of claim 5, further comprising a user input portion mounted to the rear cover.

7. The hairdryer of claim 1, wherein the air guide comprises a curved inner surface connected to an air discharge portion.

8. The hairdryer of claim 1, wherein the heater module comprises a second cylindrical heater case covering an outer circumferential surface of the heating wire, and wherein the second heater case is in contact with an inner surface of the air guide.

9. The hairdryer of claim 1, wherein the first heater case comprises: a cylindrical lateral surface portion; a front surface portion facing the gas discharge portion; and a rear surface portion positioned opposed to the front surface portion, and wherein the hairdryer comprises at least one of a front board or an ion generator positioned inside the first heater case.

10. The hairdryer of claim 1, wherein the heater module is positioned in front of a connecting portion of the handle housing.

11. The hairdryer of claim 10, further comprising: a gas introduction portion formed in a lower portion of the handle housing; and a blower fan mounted to the handle housing so as to supply air introduced through the gas introduction portion to the heater module of the body housing.

* * * * *